US009752833B2

(12) United States Patent
Gao et al.

(10) Patent No.: US 9,752,833 B2
(45) Date of Patent: Sep. 5, 2017

(54) HEAT EXCHANGER

(75) Inventors: Qiang Gao, Hangzhou (CN); Yanxing Li, Hangzhou (CN); Lin-Jie Huang, East Amherst, NY (US)

(73) Assignees: Sanhua (Hangzhou) Micro Channel Heat Exchange Co., Ltd, Zhejiang Province (CN); Danfoss A/S, Nordborg (DK)

( * ) Notice: Subject to any disclaimer, the term of this patent is extended or adjusted under 35 U.S.C. 154(b) by 971 days.

(21) Appl. No.: 13/825,051

(22) PCT Filed: May 9, 2011

(86) PCT No.: PCT/CN2011/073845

§ 371 (c)(1),
(2), (4) Date: Jul. 10, 2014

(87) PCT Pub. No.: WO2011/160501

PCT Pub. Date: Dec. 29, 2011

(65) Prior Publication Data

US 2014/0366571 A1 Dec. 18, 2014

(30) Foreign Application Priority Data

Jun. 21, 2010 (CN) ..... 2010 1 0208091

(51) Int. Cl.
*F28F 1/00* (2006.01)
*F25B 1/00* (2006.01)
(Continued)

(52) U.S. Cl.
CPC ..... *F28F 1/00* (2013.01); *F25B 1/005* (2013.01); *F25B 39/02* (2013.01); *F25B 40/00* (2013.01);
(Continued)

(58) Field of Classification Search
CPC .. F28F 1/00; F28F 9/027; F28F 9/0234; F28F 2250/06; F26D 1/0476; F26D 15/04; F28D 15/04
(Continued)

(56) References Cited

U.S. PATENT DOCUMENTS 1,227,770 A 5/1917 Fleischmann
2,097,602 A 11/1937 Rohlin
(Continued)

FOREIGN PATENT DOCUMENTS

CN 2034087 U 3/1989
CN 1134747 A 10/1996
(Continued)

OTHER PUBLICATIONS

International Search Report and Written Opinion of the International Searching Authority for PCT International Application No. PCT/CN2011/073845 dated Aug. 18, 2011.
(Continued)

*Primary Examiner* — Mohammad M Ali
(74) *Attorney, Agent, or Firm* — Howard & Howard Attorneys PLLC

(57) ABSTRACT

A heat exchanger comprises a first header (1), a second header (2) spaced apart from the first header (1) by a predetermined distance, flat tubes (3) each of which defines two ends connected to the first and second headers (1, 2), respectively, to communicate the first and second headers (1, 2), fins (4) interposed between adjacent flat tubes (3), and a flow member defining a fluid-flow passage and forming a partition-wall-type heat-exchanging unit with the second header (2). A refrigeration system comprises a compressor, a condenser, a throttle device, and an evaporator that is the heat exchanger. The compressor, condenser, throttle device, and evaporator are connected sequentially, and at least part
(Continued)

of refrigerant flowing out of an outlet of the condenser enters into the flow member to exchange heat with a refrigerant flowing out of an outlet of the evaporator.

26 Claims, 15 Drawing Sheets

(51) Int. Cl.
*F28D 15/04* (2006.01)
*F25B 39/02* (2006.01)
*F25B 40/00* (2006.01)
*F28D 1/047* (2006.01)
*F28F 9/02* (2006.01)

(52) U.S. Cl.
CPC ..... *F28D 1/0476* (2013.01); *F28D 15/04* (2013.01); *F28F 9/027* (2013.01); *F28F 9/0234* (2013.01); *F28F 2250/06* (2013.01)

(58) Field of Classification Search
USPC ..... 62/498; 165/173, 104.26
See application file for complete search history.

(56) References Cited

U.S. PATENT DOCUMENTS 2,970,812 A 2/1961 Kritzer
3,209,820 A 10/1965 Lauterbach
3,228,367 A 1/1966 Donaldson
3,265,127 A 8/1966 Nickol et al.
3,831,670 A 8/1974 Mullings
4,000,779 A 1/1977 Irwin
4,458,665 A 7/1984 Vandervaart
4,691,766 A 9/1987 Wurz et al.
5,246,064 A 9/1993 Hoshino et al.
5,271,458 A 12/1993 Yamamoto et al.
5,406,805 A 4/1995 Radermacher et al.
5,526,876 A 6/1996 Karube
5,669,438 A 9/1997 Beales et al.
5,679,106 A 10/1997 Ohno et al.
5,730,366 A 3/1998 DeWitt
5,787,972 A 8/1998 Beamer et al.
5,910,167 A 6/1999 Reinke et al.
6,074,507 A 6/2000 Sukenik
6,096,656 A 8/2000 Matzke et al.
6,199,401 B1 3/2001 Haussmann
6,213,196 B1 4/2001 Ozaki et al.
6,729,386 B1 5/2004 Sather
6,874,345 B2 4/2005 Stoynoff, Jr.
7,231,965 B2 6/2007 Shimoya et al.
7,793,514 B2 9/2010 Rios et al.
7,882,708 B2 2/2011 Richter et al.
2002/0066553 A1* 6/2002 Fischer ..... F28D 1/05391 165/174
2002/0174978 A1 11/2002 Beddome et al.
2003/0221819 A1* 12/2003 Jang ..... F28D 1/05391 165/173
2004/0251004 A1 12/2004 Stoynoff, Jr.
2005/0229630 A1 10/2005 Richter et al.
2005/0232861 A1 10/2005 Buchanan et al.
2006/0070726 A1 4/2006 Yoshioka et al.
2006/0137870 A1* 6/2006 Ohhashi ..... F28D 1/05391 165/174
2006/0236718 A1* 10/2006 Lundberg ..... F28D 1/05391 62/515
2007/0039724 A1 2/2007 Trumbower et al.
2007/0144714 A1 6/2007 Yabe et al.
2007/0199686 A1 8/2007 Okinotani et al.
2008/0010829 A1* 1/2008 Rohrbaugh ..... F28D 7/1607 29/890.036
2008/0093051 A1 4/2008 Rios et al.
2008/0141706 A1* 6/2008 Tucker ..... F25B 39/028 62/498
2008/0169085 A1* 7/2008 Oh ..... F28D 1/05391 165/70
2008/0173434 A1 7/2008 Matter et al.
2008/0283229 A1* 11/2008 Takai ..... F28F 9/0224 165/153
2008/0314569 A1* 12/2008 Yamazaki ..... F02M 25/0737 165/153
2009/0025914 A1* 1/2009 Knight ..... F25B 39/00 165/144
2009/0114379 A1* 5/2009 Lim ..... B23P 15/26 165/151
2009/0173482 A1 7/2009 Beamer et al.
2009/0218084 A1* 9/2009 Shinhama ..... F25B 39/04 165/175
2009/0236086 A1* 9/2009 Higashiyama ..... F25B 39/02 165/176
2009/0266104 A1* 10/2009 Ichiyanagi ..... F25B 39/00 62/498
2010/0031698 A1* 2/2010 Higashiyama ..... F25B 39/028 62/525
2010/0065244 A1* 3/2010 Yokoyama ..... F28D 1/05383 165/10
2010/0083694 A1* 4/2010 Takagi ..... F25B 39/022 62/515
2010/0089559 A1 4/2010 Gorbounov et al.
2010/0108301 A1* 5/2010 Hiraoka ..... F02C 7/143 165/117
2010/0116474 A1 5/2010 Kerler et al.
2010/0290947 A1* 11/2010 Nakao ..... A61M 1/1698 422/46
2011/0061844 A1* 3/2011 Jianlong ..... F28D 1/053 165/173
2011/0100614 A1* 5/2011 Oh ..... F28D 1/05391 165/173
2011/0209860 A1 9/2011 Koenig et al.
2014/0366571 A1 12/2014 Gao et al.

FOREIGN PATENT DOCUMENTS

CN 1203115 A 12/1998
CN 1266977 A 9/2000
CN 1523317 A 8/2004
CN 1672006 A 9/2005
CN 1782601 A 6/2006
CN 1920369 A 2/2007
CN 101111730 A 1/2008
CN 101482346 A 7/2009
CN 101548150 A 9/2009
CN 101660870 A 3/2010
CN 101680689 A 3/2010
CN 201425433 Y 3/2010
CN 101694360 A 4/2010
CN 201443932 U 4/2010
CN 101738123 A 6/2010
CN 101738126 A 6/2010
CN 201555495 U 8/2010
CN 101839590 A 9/2010
CN 101865574 A 10/2010
CN 102012186 A 4/2011
DE 3515441 A1 10/1986
DE 4219642 C1 6/1992
DE 4219642 C1 10/1993
EP 1111318 A1 6/2001
GB 1488842 10/1977
JP 636632 Y2 2/1988
JP 4187990 A 7/1992
JP 2000193388 A 7/2000
JP 200555013 A 3/2005
JP 2006284133 A 10/2006
JP 2009236470 A 10/2009
WO 2006028403 A1 3/2006
WO 2006039148 A2 4/2006

(56) References Cited

FOREIGN PATENT DOCUMENTS

| | | | |
|---|---|---|---|
| WO | 2006083426 | A1 | 8/2006 |
| WO | 2010040635 | A1 | 4/2010 |

OTHER PUBLICATIONS

Notification of Second Office Action dated Apr. 23, 2012 by the State Intellectual Property Office for Chinese Patent Application No. 201010208091.X.

* cited by examiner

HEAT EXCHANGER

CROSS-REFERENCE TO RELATED APPLICATIONS

This application is a "national phase" application and claims priority to International Patent Application PCT/CN2011/073845 filed on May 9, 2011, which, in turn, is based upon and claims priority to Chinese Patent Application 201010208091.X filed on Jun. 21, 2010 and entitled "Heat Exchanger," which is hereby incorporated by reference in its entirety.

BACKGROUND OF INVENTION

1. Field of Invention

The indention relates to, in general, a hear exchanger and, more particularly, a micro-channel heat exchanger.

2. Description of Related Art

When a micro-channel heat exchanger is used as an evaporator, a gaseous and liquid (two-phase) refrigerant enters into a plurality of flat tubes from an inlet header of the micro-channel heat exchanger, exchanges heat with the air in the environment, and then is discharged cot of the micro-channel heat exchanger from an outlet header. If the refrigerant is completely evaporated into a gaseous refrigerant after passing through the evaporator, a part of gaseous refrigerant may generally exist in a portion of each flat tube adjacent to the outlet of the flat tube such that the heat-exchange capability of the evaporator may not be given fully play to. In other words, the refrigerant has been completely evaporated into the gaseous refrigerant before flowing out of the flat tubes such that the gaseous refrigerant in a portion of each flat tube connected to the outlet header may not exchange heat with the air in the environment and, consequently, the heat-exchange capability of the evaporator may not be given fully play to. If the evaporated refrigerant is not completely evaporated into the gaseous refrigerant (that is, the evaporated refrigerant contains a part of liquid refrigerant), although the heat-exchange capability of the evaporator may be given fully play to, the compressor may suck the gaseous refrigerant containing the liquid refrigerant, which is disadvantageous for the compressor, and even the refrigerating system cannot run.

The invention seeks to solve at least one of the problems existing in the related art to at least some extent. Accordingly, an object of the invention is to provide a heat exchanger with good heat-exchange capability, and the gaseous refrigerant sucked by the compressor does not contain the liquid refrigerant. Another object of the invention is to provide a refrigeration system comprising the heat exchanger.

SUMMARY OF INVENTION

Embodiments of a first broad aspect of the invention overcome disadvantages in the related art in a heat exchanger comprising a first header, a second header spaced apart from the first header by a predetermined distance, a plurality of flat tubes each of which defines two ends connected to the first and second headers, respectively, to communicate the first and second headers, a plurality of fins interposed between adjacent flat tubes, and a flow member defining a fluid-flow passage and forming a partition-wall-type heat-exchanging unit with the second header.

Embodiments of a second broad aspect of the invention overcome disadvantages in the related art also in a refrigeration system comprising a compressor, a condenser, a throttle device, and an evaporator that is the heat exchanger. The compressor, condenser, throttle device, and evaporator are connected sequentially, and at least part of refrigerant flowing out of an outlet of the condenser enters into the flow member to exchange heat with a refrigerant flowing out of an outlet of the evaporator.

When the heat exchanger according to embodiments of the invention is used as an evaporator, the gaseous refrigerant flowing out of an outlet of the evaporator contains a part of liquid refrigerant and may exchange heat with the liquid refrigerant flowing out of an outlet of a condenser of a refrigeration system. On one hand, the under-cooling degree of the liquid refrigerator flowing out of the outlet of the condenser may be further increased. On the other hand, the liquid refrigerant contained in the gaseous refrigerant flowing out of the outlet of the evaporator and partly evaporated in the evaporator may be completely evaporated so that the heat-exchange capability of the heat exchanger is improved and no liquid refrigerant enters into the compressor. In addition, the ideal design of the evaporator is that the refrigerant flowing out of the flat tubes is completely gaseous refrigerant. However, this has high requirements for the design of the evaporator, and this may be hard to realize under different running conditions. However, with the heat exchanger according to embodiments of the invention, the evaporator is simple to design and high in applicability.

In one embodiment, the flow member includes a first partition plate disposed in the second header along an axial direction of the second header to divide an inner chamber of the second header into first, second, and third chambers, the first chamber is communicated with the plurality of flat tubes and isolated from the second and third chambers, and the second and third chambers are communicated with each other. The second and third chambers are communicated with each other at rear ends thereof, the second chamber is formed with an inlet in a front-end surface thereof, and the third chamber is formed with an outlet in a front-end surface thereof. The first partition plate is substantially T-shaped.

In another embodiment, the flow member includes a flow tube disposed in the second header along an axial direction of the second header and defining inlet and outlet ends that are extended out of the second header.

In one embodiment, the flow tube is disposed at a lower portion of an inner chamber of the second header, and the inlet and outlet ends of the flow tube are extended out from front and rear-end surfaces of the second header, respectively.

In another embodiment, the flow member includes further a second partition plate dividing an inner chamber of the second header into upper and lower chambers communicated with each other, the flow tube is disposed in the lower chamber, and the outlet end of the flow tube is extended into the first header. The upper and lower chambers are communicated with each other at rear ends thereof, the inlet end of the flow tube is extended out of the second header from a lower side of a front portion of the second header along a radial direction of the second header, and the outlet end of the flow tube is extended out of the second header from a rear-end surface of the lower chamber. A throttle mechanism is disposed in a portion of the flow tube extended between the first and second headers.

In still another embodiment, the flow tube has a circular cross-section.

In yet another embodiment, the flow tube is a micro-channel tube defining a plurality of micro-channels therein. The micro-channel tube has a circular arc cross-section. The flow member includes further inlet and outlet manifolds that are connected to two ends of the micro-channel tube, respectively, and inner chambers of inlet and outlet manifolds are communicated with the plurality of micro-channels of the micro-channel tube, respectively.

In still another embodiment, the micro-channel tube is U-shaped, and a plurality of corrugated sub-fins are interposed between two side walls of the U-shaped micro-channel tube.

In another embodiment, the flow member includes a plurality of capillary tubes.

In still another embodiment, the heat exchanger comprises further a third header communicated with an upper portion of an inner chamber of the second header, and a gas-outlet pipe is disposed and communicated with an inner chamber of the third header. The third header is communicated with the inner chamber of the second header via a plurality of first connection tubes.

In yet another embodiment, the flow member includes a flow tube, third and fourth partition plates are disposed in the flow tube and divide an inner chamber of the flow tube into fourth, fifth and sixth chambers, the fourth chamber is communicated with an inner chamber of the second header, and the fifth and sixth chambers are communicated with each other and isolated from the fourth chamber. The fifth and sixth chambers are communicated with each other at rear ends thereof, the fifth chamber is formed with an inlet in a front-end surface thereof, and the sixth chamber is formed with an outlet in a front-end surface thereof. The fourth chamber is communicated with the inner chamber of the second header via a plurality of second connection tubes connected between the flow tube and the second header.

In another embodiment, the heat exchanger comprises further a third header communicated with an upper portion of an inner chamber of the second header, a gas-outlet pipe is disposed and communicated with an inner chamber of the third header, and the flow member includes a flow tube disposed in the third header and defining inlet and outlet ends that are extended out of the third header. The inlet end of the flow tube is extended out from a front portion of the third header along a radial direction of the third header, and the outlet end of the flow tube is extended out from a rear-end surface of the third header. The outlet end of the flow tube is extended into the first header. A throttle mechanism is disposed in a portion of the flow tube extended between the first header and the third header.

In an alternative embodiment, each flat tube includes a bent segment and straight segments connected to first and second ends of the bent segment, respectively, the bent segment is twisted relative to the straight segments by a predetermined angle, and the fins are interposed between adjacent straight segments.

With the refrigeration system according to an embodiment of the invention, the gaseous refrigerant flowing out of an outlet of the evaporator contains a part of liquid refrigerant and may exchange heat with the liquid refrigerant flowing out of an outlet of the condenser of the refrigeration system. On one hand, the under-cooling degree of the liquid refrigerator flowing out of the outlet of the condenser may be further increased. On the other hand, the liquid refrigerant contained in the gaseous refrigerant flowing out of the outlet of the evaporator and partly evaporated in the evaporator may be completely evaporated so that the heat-exchange capability of the heat exchanger is improved and no liquid refrigerant enters into the compressor. As described above, the ideal design of the evaporator is that the refrigerant flowing out of the flat tubes is completely gaseous refrigerant. However, this has high requirements for the design of the evaporator, and this may be hard to realize under different running conditions. However, with the heat exchanger according to embodiments of the invention, the evaporator is simple to design and high in applicability.

Other objects, features, and advantages of the invention are readily appreciated as the same becomes better understood while the subsequent detailed description of embodiments of the invention is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

Figure 1:
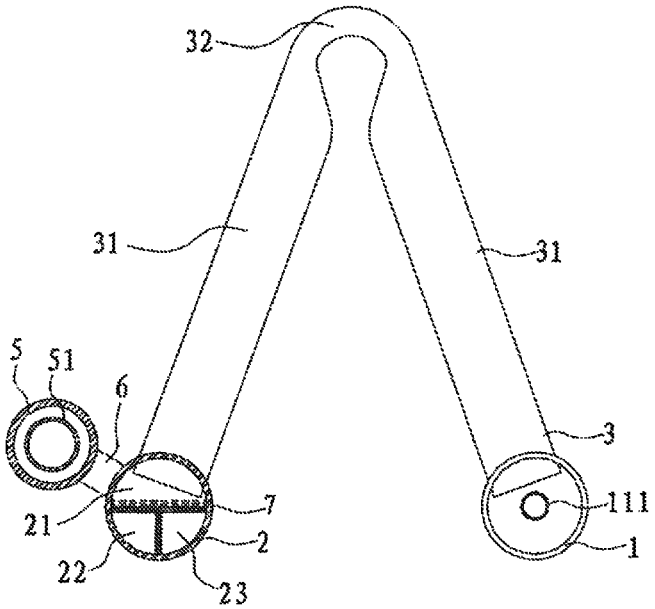
FIG. 1 is a schematic view of a heat exchanger according to a first embodiment of the invention in which a flow member includes a first partition plate.

Reference is made in detail to embodiments of the invention. The embodiments described herein with reference to the drawing are explanatory and illustrative and used to generally understand the invention. The embodiments shall not be construed to limit the invention. The same or similar elements and the elements having the same or similar functions are denoted by like reference numerals throughout the description.

Unless specified or limited otherwise, relative terms such as "central," "longitudinal," "lateral," "front," "rear," "right," "left," "inner," "outer," "lower," "upper," "horizontal," "vertical," "above," "below," "up," "top," and "bottom" as well as derivatives thereof (e.g., "horizontally," "downwardly," "upwardly," etc.) should be construed to refer to the orientation as then described or as shown in the figure(s) under discussion. These relative terms are for convenience of description and do not require that the invention be constructed or operated in a particular orientation. In addition, the terms "outlet" and "outlet tube" have the same meaning, and the terms "inlet" and "inlet tube" have the same meaning. The terms "first refrigerant" and "second refrigerant" are used for distinguishing the source of the refrigerant and for convenience of description, but shall not be construed to limit the invention.

In the following description, the heat exchanger according to embodiments of the invention is described by taking the use of the heat exchanger as an evaporator (as an example), wherein a first header is used as the inlet header, a second header is used as the outlet header, a refrigerant evaporated in the evaporator is referred to as a "first refrigerant" (may also be referred to as a "cold refrigerant"), and a refrigerant in a flow member is referred to as a "second refrigerant" (may also be referred to as a "hot refrigerant").

The heat exchanger according to embodiments of the first aspect of the invention is described below with reference to FIGS. 1-26. The heat exchanger according to embodiments of the invention comprises a first header 1, a second header 2, a plurality of flat tubes 3, a plurality of fins 4, and a flow member, wherein the second header 2 is spaced apart from the first header 1 by a predetermined distance.

Each flat tube 3 defines two ends connected to the first and second headers 1, 2, respectively, to communicate the first and second headers 1, 2 via micro-channels in each flat tube 3. The fins 4 are interposed between adjacent flat tubes 3, respectively. The flow member defines a fluid-flow passage therein and forms a partition-wall-type heat-exchanging unit (also referred as "surface heat-exchanging unit") with the second header 2. The flow passage of the flow member is configured as a first fluid-flow passage (e.g., a hot-fluid-flow passage) of the partition-wall-type heat-exchanging unit, and an inner chamber of the second header 2 is configured as a second fluid-flow passage (e.g., a cold-fluid-flow passage) of the partition-wall-type heat-exchanging unit such that a second refrigerant in the flow member may exchange heat with a first refrigerant in the second header 2.

In one embodiment, each flat tube 3 is flat-plate-shaped such that a flat-plate type heat exchanger is formed.

In another embodiment, as shown in FIG. 1, each flat tube 3 includes a bent segment 32 and straight segments 31 connected to first and second ends of the bent segment 32, respectively, the bent segment 32 is twisted relative to the straight segments 31 by a predetermined angle, and the fins 4 are interposed between adjacent straight segments 31 such that a bent heat exchanger is formed.

When the heat exchanger according to embodiments of the invention is used as an evaporator, the gaseous refrigerant flowing out of the outlet of the evaporator contains a part of liquid refrigerator and may exchange heat with the refrigerant flowing out of the outlet of a condenser of a refrigeration system. On one hand, the under-cooling degree of the liquid refrigerator flowing out of the outlet of the condenser may be further increased. On the other hand, the liquid refrigerant contained in the gaseous refrigerant partly evaporated in the evaporator may be completely evaporated so that the heat-exchange capability of the heat exchanger is improved significantly and no liquid refrigerant enters into the compressor in addition, the evaporator is simple to design and high in applicability.

The heat exchanger having different types of flow members according to embodiments of the invention are described below in detail with reference to the drawing.

Embodiment 1

As shown in FIGS. 1-4, in the heat exchanger according to a first embodiment of the invention, the flow member includes a first partition plate 7 disposed in the second header 2 and extended along an axial direction (i.e., an inward and outward direction in FIG. 1 or a left and right direction in FIG. 2) of the second header 2. In one example, the first partition plate 7 is substantially T-shaped.

As shown in FIG. 1, the first partition plate 7 divides an inner chamber of the second header 2 into first, second, and third chambers 21, 22, 23, the first chamber 21 is communicated with the plurality of flat tubes 3 and isolated from the second and third chambers 22, 23, and the second and third chambers 22, 23 are communicated with each other. Therefore, the first chamber 21 accommodates the first refrigerant flowing out of the flat tubes 3 and is used as a cold-fluid-flow passage of the partition-wall-type heat-exchanging unit, and the second and third chambers 22, 23 are used as a hot-fluid-flow passage of the partition-wall-type heat-exchanging unit such that the first refrigerant in the first chamber 21 may exchange heat with the second refrigerant (for example, the refrigerant flowing out of an outlet of a condenser of a refrigeration system) in the second and third chambers 22, 23 via the first partition plate 7.

Figure 2:
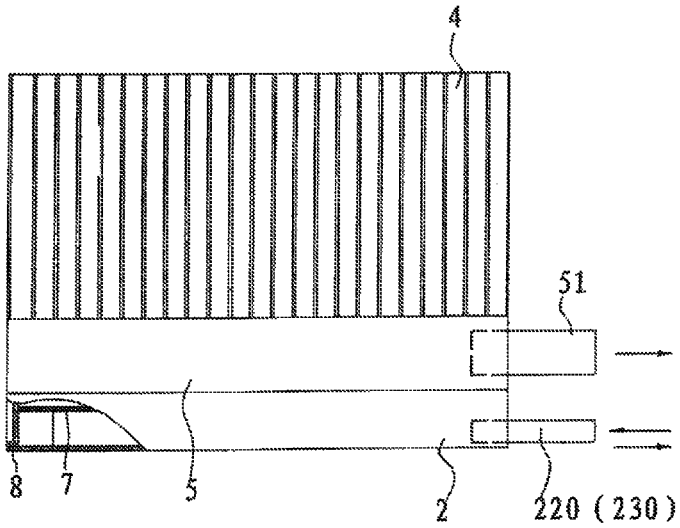
FIG. 2 is a left view of the heat exchanger shown in FIG. 1.

In one example, the second and third chambers 22, 23 are communicated with each other at rear ends (i.e., left ends in FIG. 2) thereof. As shown in FIG. 2, the rear end of the second header 2 is closed, for example, by an end seal plate 9, the front end (i.e., right end in FIG. 2) of the second header 2 is closed by an end cover 9, a horizontal portion of the first partition plate 7 is connected to the end seal plate 8 to isolate the first chamber 21 from the second and third chambers 22, 23, and a vertical portion of the first partition plate 7 is not extended to the end seal plate 8 such that the second and third chambers 22, 23 are communicated with each other at the rear ends thereof. It should be noted that the invention is not limited to the second and third chambers 22, 23 being communicated with each other at the rear ends thereof.

Figure 3:
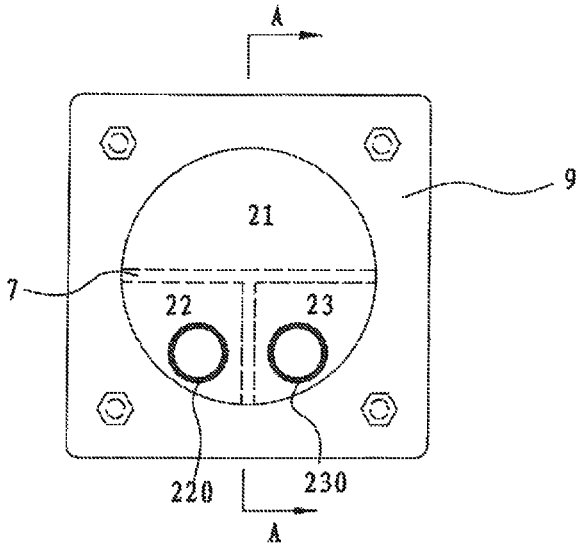
FIG. 3 is an enlarged schematic view of an end surface of a second header of the heat exchanger shown in FIG. 1.
Figure 4:
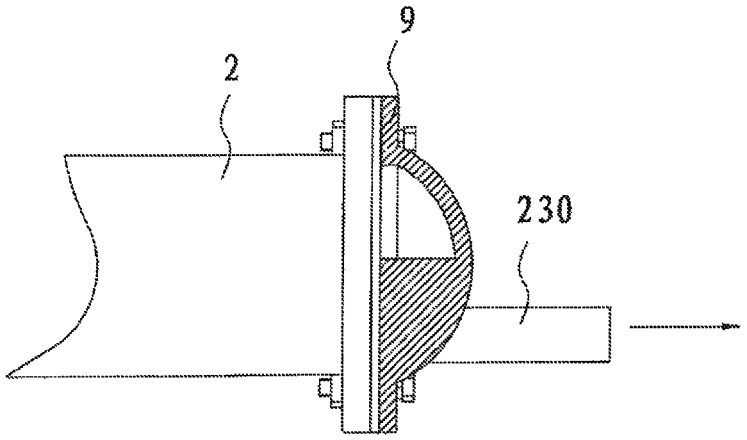
FIG. 4 is a sectional view of the end surface of the second header taken along "A-A" in FIG. 3.

As shown in FIGS. 2-4, the second chamber 22 is formed with an inlet 220 in a front-end surface thereof, the third chamber 23 is formed with an outlet 230 in a front-end surface thereof, and the outlet end [the front end (i.e., the right end in FIG. 2)] of the second header 2 is closed by the end cover 9. Therefore, the second refrigerant enters into the second chamber 22 from the inlet 220 and then enters into the third chamber 23 from the rear end of the second chamber 22, the second refrigerant in the third chamber 23 flows toward the front end of the third chamber 23 and then is discharged out of the third chamber 23 from the outlet 230, and the second refrigerant (for example, at least part of refrigerant flowing out of the outlet of the condenser of the refrigeration system) may exchange heat with the first refrigerant in the first chamber 21 when flowing in the second and third chambers 22, 23. The first refrigerant in the first chamber 21 is supplied to the first header 1 from an inlet time 111 of the first header 1 and then flows through the flat tubes 3 into the first chamber 21 of the second header 2. The first refrigerant is evaporated by exchanging heat with the air in the environment when flowing through the flat tubes 3, the first refrigerant in the first chamber 21 is discharged out of the first chamber 21 (that is, the first refrigerant in the first chamber 21 is discharged out of the second header 2) after exchanging heat with the second refrigerant in the second and third chambers 22, 23, and the second refrigerant in the second and third chambers 22, 23 is discharged out of the second header 2 from the outlet 230 after heat exchange.

In some examples, the heat exchanger according to the first embodiment of the invention comprises further a third header 5. The third header 5 is communicated with an upper portion (e.g., the first chamber 21) of the inner chamber of the second header 2, and a gas-outlet pipe 51 is disposed on the third header 5 and communicated with an inner chamber of the third header 5. For example, the gas-outlet pipe 51 is disposed on a front-end surface of the third header 5. Alternatively, the third header 5 is communicated with the first chamber 21 of the second header 2 via a plurality of first connection tubes 6. After the first refrigerant in the first chamber 21 exchanges heat with the second refrigerant in the second and third chambers 22, 23, the liquid part of the first refrigerant may be evaporated into a gaseous refrigerant by heat exchange, and then the gaseous first refrigerant enters into the third header 5 through the first connection tubes 6, is discharged out of the third header 5 from the gas-outlet pipe 51, and then, for example, enters into a compressor.

When the heat exchanger according to the first embodiment of the invention is used as an evaporator, the gaseous and liquid (two-phase) first refrigerant enters into the first header 1 from the inlet tube 111 and then enters into the flat tubes 3 to exchange heat with the air in the environment and be evaporated into the gaseous and liquid first refrigerant containing a part of unevaporated liquid refrigerant, and the gaseous and liquid (two-phase) first refrigerant containing a part of unevaporated liquid refrigerant enters into the first chamber 21 of the second header 2. A part of the second refrigerator flowing out of an outlet of a condenser of a refrigeration system enters into the second chamber 22 of the second header 2 from the inlet 220 of the second chamber 22, flows toward the rear end of the second chamber 22, enters into the third chamber 23 from the rear end of the second chamber 22, and then flows out of the third chamber 23 from the outlet 230. When flowing in the second and third chambers 22, 23, the second refrigerant exchanges heat with the first refrigerant in the first chamber 21 such that the temperature of the first refrigerant in the first chamber 21 is increased and the liquid refrigerant in the first refrigerant is completely evaporated into a gaseous refrigerant. The gaseous first refrigerant enters into the third header 5 through the first connection tubes 6, is discharged out of the third header 5 from the gas-outlet pipe 51, and then, for example, is sucked into the compressor. The second refrigerant, after heat exchange, may return back to the inlet header 1 of the evaporator through an external throttle mechanism. Therefore, the liquid refrigerant contained in the first refrigerant may be completely evaporated, no liquid refrigerant enters into the compressor, and the heat-exchange capacity may be improved. Meanwhile, the undercooling degree of the liquid refrigerant flowing out of the outlet of the condenser may be further increased, thus further improving the heat-exchange capacity of the heat exchanger significantly.

In addition, by dividing the second header 2 into the first, second, and third chambers 21, 22, 23 using the first partition plate 7, the second refrigerant in the second and third chambers 22, 23 mainly exchanges heat with the liquid refrigerant contained in the first refrigerant, thus further enhancing the "evaporation" effect of the liquid refrigerant contained in the first refrigerant.

Embodiment 2

Figure 5:
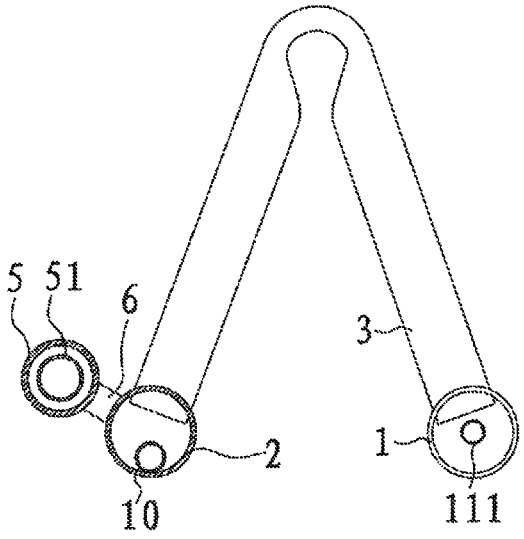
FIG. 5 is a schematic view of a heat exchanger according to a second embodiment of the invention.
Figure 6:
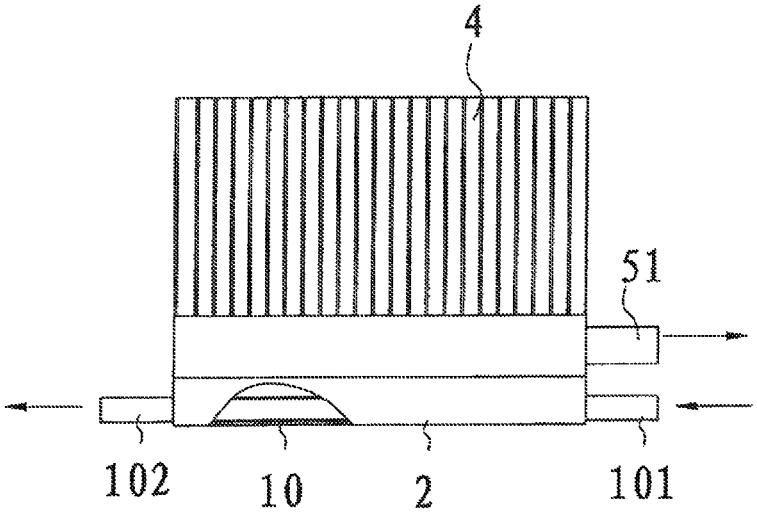
FIG. 6 is a left view of the heat exchanger shown in FIG. 5.

As shown in FIGS. 5-6, in the heat exchanger according to a second embodiment of the invention, the flow member includes a flow tube 10. The flow tube 10 is disposed in the second header 2 along an axial direction of the second header 2 and defines inlet and outlet ends 101, 102 that are extended out of the second header 2.

As shown in FIG. 5, in one example, the flow tube 10 is disposed at a lower portion of the inner chamber of the second header 2, and the inlet and outlet ends 101, 102 of the flow tube 10 are extended out front the front and rear-end surfaces of the second header 2, respectively, as shown in FIG. 6.

In some examples, the heat exchanger according to the second embodiment of the invention comprises further a third header 5. The third header 5 is communicated with an upper portion of the inner chamber of the second header 2. A gas-outlet pipe 51 is disposed on the front-end surface of the third header 5. Alternatively, the third header 5 is communicated with the inner chamber of the second header 2 via a plurality of first connection tubes 6.

When the heat exchanger according to the second embodiment of the invention is used as an evaporator, for example, a second refrigerator flowing out of an outlet of a condenser of a refrigeration system flows into the flow tube 10 from the inlet end 101, flows toward the outlet end 102, and then flows out of the flow tube 10 from the outlet end 102. When flowing in the flow tube 10, the second refrigerant exchanges heat with the evaporated first refrigerant in the second header 2. The first refrigerant, after heat exchange, enters into the third header 5 from the second header 2, flows out of the third header 5 from the gas-outlet pipe 51, and then, for example, is sucked into a compressor. Therefore, the liquid refrigerant contained in the first refrigerant may be completely evaporated. Meanwhile, the undercooling degree of the liquid refrigerant flowing out of the outlet end 102 of the flow tube 10 may be further increased, thus improving the heat-exchange capacity of the heat exchanger significantly. Moreover, the flow member has simple structure and is disposed in the second header 2, thus evaporating the liquid refrigerant contained in the first refrigerant more effectively.

Embodiment 3

Figure 7:
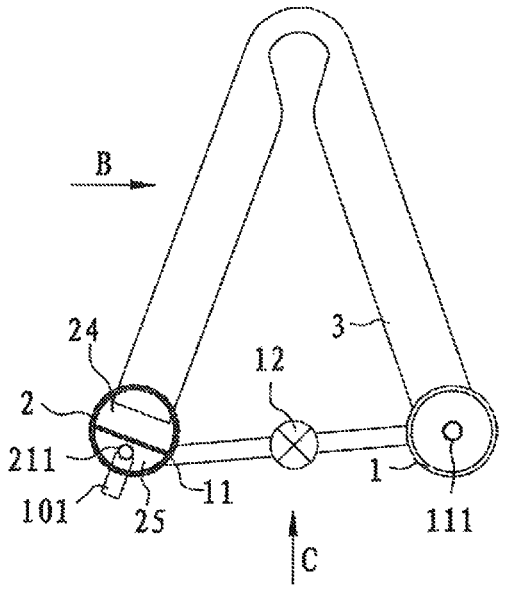
FIG. 7 is a schematic view of a heat exchanger according to a third embodiment of the invention.
Figure 8:
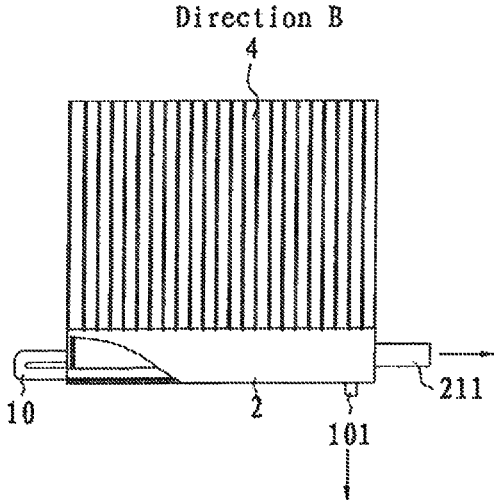
FIG. 8 is a view of the heat exchanger in a direction "B" in FIG. 7.
Figure 9:
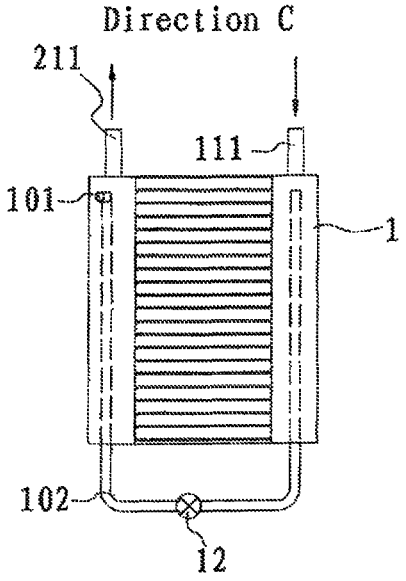
FIG. 9 is a view of the heat exchanger in a direction "C" in FIG. 7.

The heat exchanger according to a third embodiment of the invention is formed by improving the heat exchanger according to the second embodiment of the invention. As shown in FIGS. 7-9, in the heat exchanger according to the third embodiment of the invention, the flow member includes a flow tube 10 and a second partition plate 11.

The second partition plate 11 divides an inner chamber of the second header 2 into upper and lower chambers 24, 25 communicated with each other. In one example, the upper and lower chambers 24, 25 are communicated with each other at rear ends (i.e., left ends in FIG. 8) thereof such that a first refrigerant entering into the upper chamber 24 from the flat tubes 3 enters into the lower chamber 25 from the rear end of the upper chamber 24 to exchange heat with a second refrigerant in the flow tube 10. As shown in FIGS. 8-9, the flow tube 10 is disposed in the lower chamber 25. As shown in FIG. 9, the outlet end 102 of the flow tube 10 is extended into the first header 1 from the rear end of the first header 1. Alternatively, the outlet end 102 of the flow tube 10 is adjacent to the inlet tube 111 of the first header 1. In some examples, as shown in FIGS. 7-9, the inlet end 101 of the flow tube 10 is extended out of the second header 2 from a lower side of a front portion of the second header 2 along a radial direction of the second header 2, and the outlet end 102 of the flow tube 10 is extended out of the second header 2 from the rear-end surface of the lower chamber 25.

In another example, a throttle mechanism 12 is disposed in a portion of the flow tube 10 extended between the first and second headers 1, 2. Alternatively, the throttle mechanism 12 may be an expansion valve such that the second refrigerant that exchanges heat with the first refrigerant is throttled by the throttle mechanism 12 and then supplied to the first header 1 of the evaporator.

When the heat exchanger according to the third embodiment of the invention is used as an evaporator, the second refrigerator flowing out of an outlet of a condenser of a refrigeration system flows into the flow tube 10 from the inlet end 101, exchanges heat with the evaporated first refrigerant in the second header 2, flows out of the flow tube 10 from the outlet end 102, is throttled by the expansion valve 12, and then supplied to the first header 1. The evaporated first refrigerant, after heat exchange, flows out of the second header 2 from an outlet 211 of the second header 2 and then, for example, enters into the compressor.

In the second and third embodiments of the invention, as shown, in FIGS. 5 and 7, the flow tube 10 has a circular cross-section. The flow tube 10 is disposed in the second header 2 along the axial direction of the second header 2 and defines inlet and outlet ends 101, 102 that are extended out of the second header 2.

Embodiment 4

Figure 10:
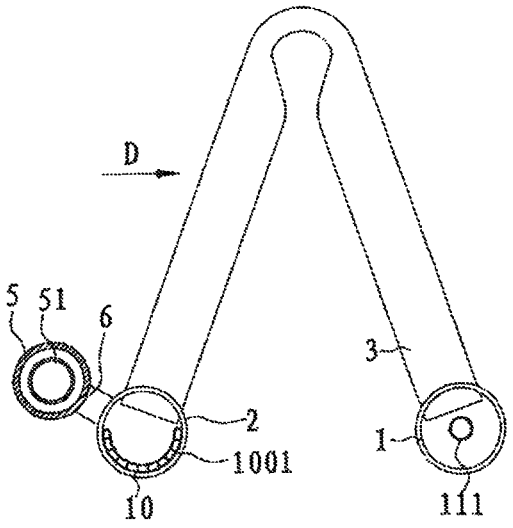
FIG. 10 is a schematic view of a heat exchanger according to a fourth embodiment of the invention.
Figure 11:
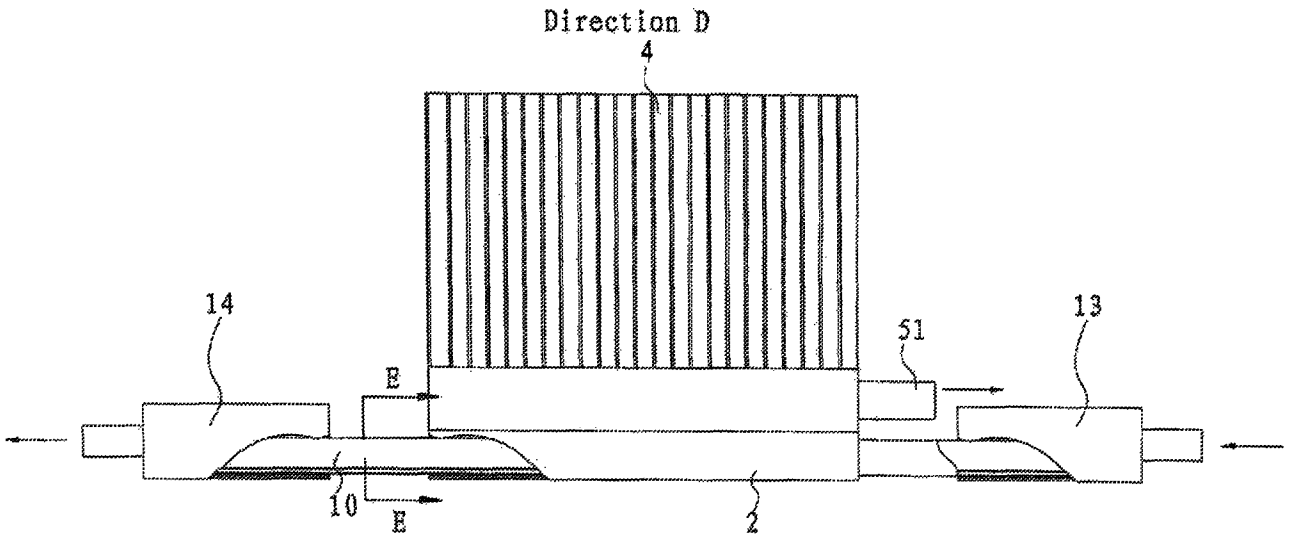
FIG. 11 is a view of the heat exchanger in a direction "D" in FIG. 10.
Figure 12:
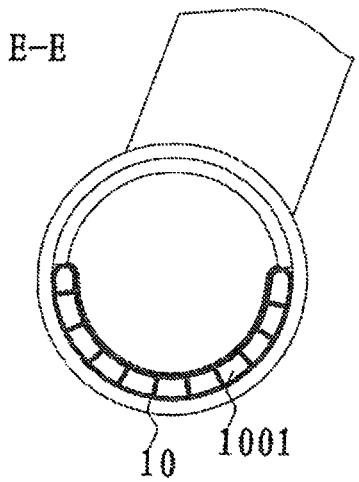
FIG. 12 is a sectional view of the heat exchanger taken in a direction "E-E" in FIG. 11.

As shown in FIGS. 10-12, in the heat exchanger according to a fourth embodiment of the invention, the flow tube 10 is a micro-channel tube defining a plurality of micro-channels 1001 therein. In some examples, the micro-channel tube has a circular arc cross-section to attach to an inner wall of the second header 2, as shown in FIGS. 10 and 12.

In one example, the flow member includes further inlet and outlet manifolds 13, 14 that are connected to two ends of the micro-channel tube, respectively, and inner chambers of inlet and outlet manifolds 13, 14 are communicated with the plurality of micro-channels 1001 of the micro-channel tube, respectively, as shown in FIG. 11.

In one example, the heat exchanger comprises further a third header 5. The third header 5 is communicated with an upper portion of the inner chamber of the second header 2, and a gas-outlet pipe 51 is disposed on the third header 5 and communicated with an inner chamber of the third header 5. Alternatively, the third header 5 is communicated with the inner chamber of the second header 2 via a plurality of first connection tubes 6.

When the heat exchanger according to the fourth embodiment of the invention is used as an evaporator, the second refrigerator flowing out of an outlet of a condenser of a refrigeration system flows into the plurality of micro-channels 1001 of the micro-channel tube from the inlet manifold 13, exchanges heat with the evaporated first refrigerant in the second header 2, and then flows out of the plurality of micro-channels 1001 of the micro-channel tube from the outlet manifold 14. After exchanging heat with the second refrigerant, the first refrigerant enters into the third header 5 through the first connection tubes 6, is discharged out of the third header 5 from the gas-outlet pipe 51, and then, for example, is sucked into a compressor. Because the flow tube 10 is a micro-channel tube, the heat-exchange efficiency between the first refrigerant and the second refrigerant is, thus, enhanced.

Embodiment 5

The heat exchanger according to a fifth embodiment of the invention is an improvement of the heat exchanger according to the fourth embodiment of the invention. As shown in FIGS. 13-16, the flow tube 10 is a U-shaped micro-channel tube defining a plurality of micro-channels 1001 therein, wherein a plurality of corrugated sub-fins 15 are interposed between two side walls of the U-shaped micro-channel tube.

Figure 14:
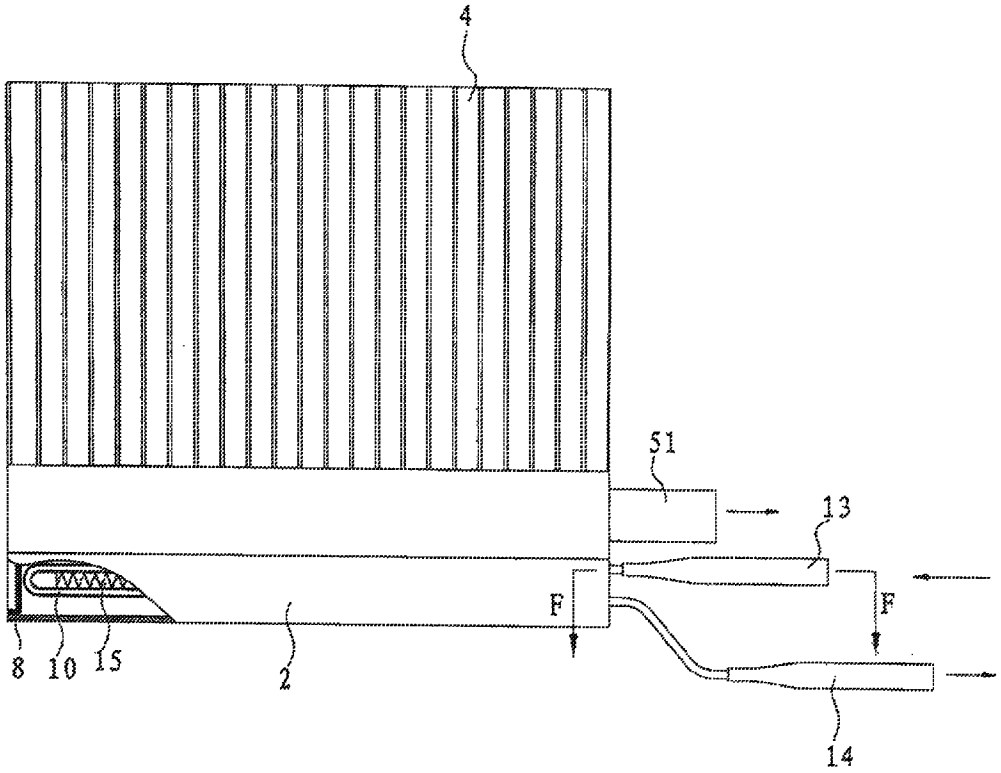
FIG. 14 is a left view of the heat exchanger shown in FIG. 13.

As shown in FIG. 14, in some examples, the flow member includes further inlet and outlet manifolds 13, 14 that are connected to two ends of the U-shaped micro-channel tube, respectively, and inner chambers of inlet and outlet manifolds 13, 14 are communicated with the plurality of micro-channels 1001 of the U-shaped micro-channel tube, respectively. As shown in FIG. 14, two ends of the U-shaped micro-channel tube are extended out from a front end of the second header 2, and a rear end of the second header 2 is sealed by a seal plate 8.

Figure 13:
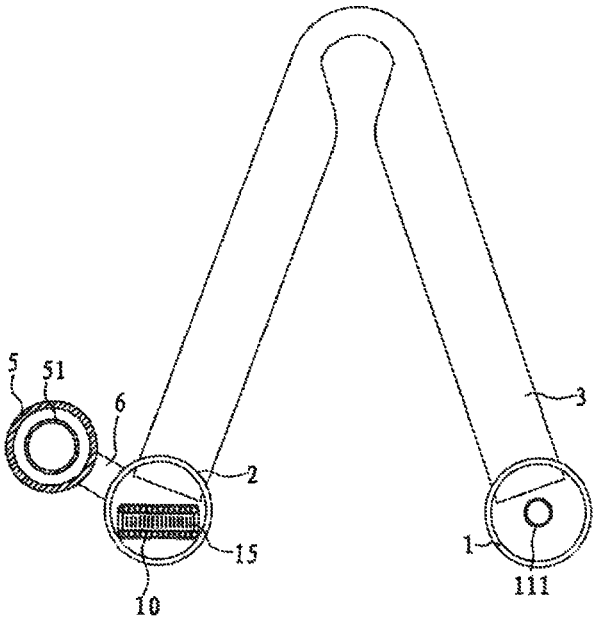
FIG. 13 is a schematic view of a heat exchanger according to a fifth embodiment of the invention.

As shown in FIG. 13, the heat exchanger according to the fifth embodiment of the invention may comprise further a third header 5. The third header 5 is communicated with an upper portion of the inner chamber of the second header 2, and a gas-outlet pipe 51 is disposed on the third header 5 and communicated with an inner chamber of the third header 5. Alternatively, the third header 5 is communicated with the inner chamber of the second header 2 via a plurality of first connection tubes 6.

Figure 15:
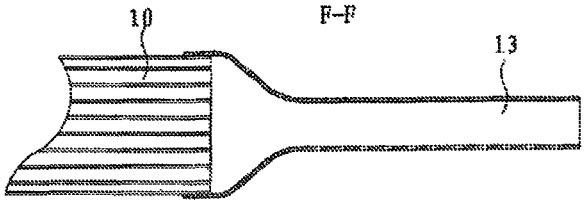
FIG. 15 is a sectional view of the heat exchanger taken along a direction "F-F" in FIG. 14.
Figure 16:
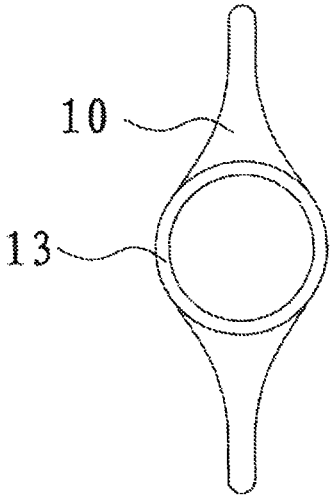
FIG. 16 is a right view of the heat exchanger shown in FIG. 13.

When the heat exchanger according to the fifth embodiment of the invention is used as an evaporator, as shown in FIGS. 14-16, a second refrigerator flowing out of an outlet of a condenser of a refrigeration system flows into the plurality of micro-channels 1001 of the U-shaped micro-channel tube from the inlet manifold 13, exchanges heat with a first refrigerant in the second header 2 when flowing in the U-shaped micro-channel tube, and then flows out of the plurality of micro-channels 1001 of the U-shaped micro-channel tube from the outlet manifold 14. The plurality of corrugated sub-fins 15 interposed between two side walls of the U-shaped micro-channel tube are used for enhancing the above heat exchange. After exchanging heat with the second refrigerant, the first refrigerant is completely evaporated into a gaseous refrigerant, the temperature of the first refrigerant may be increased, and the first refrigerant enters into the third header 5 through the first connection tubes 6, is discharged out of the third header 5 from the gas-outlet pipe 51, and then, for example, is sucked into a compressor.

Embodiment 6

Figure 17:
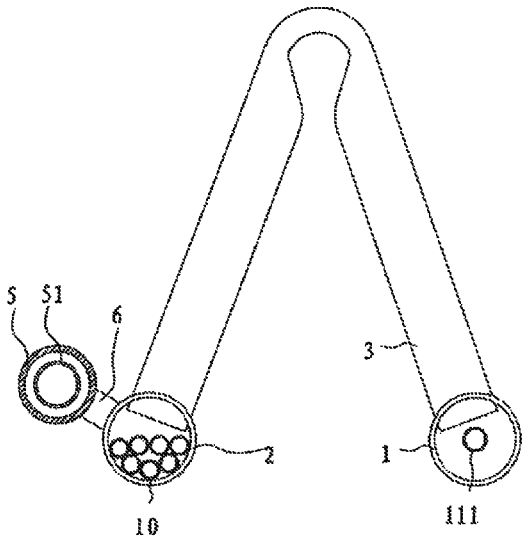
FIG. 17 is a schematic view of a heat exchanger according to a sixth embodiment of the invention.
Figure 18:
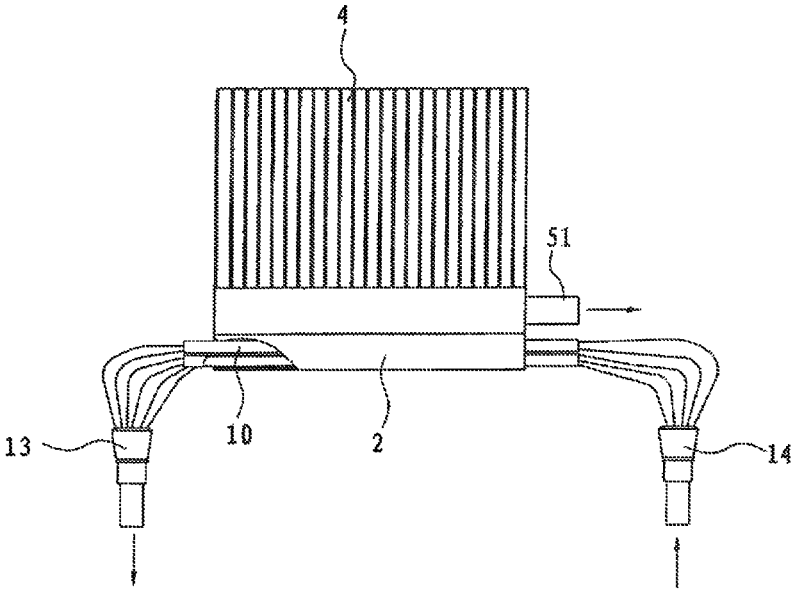
FIG. 18 is a left view of the heat exchanger shown in FIG. 17.

As shown in FIGS. 17-18, in the heat exchanger according to a sixth embodiment of the invention, the flow member includes a plurality of capillary tubes 10. Inlet ends of the plurality of capillary tubes 10 are connected to an inlet manifold 13, and outlet ends of the plurality of capillary tubes 10 are connected to an outlet manifold 14. In one example, the diameter of each capillary tube 10 may be about one millimeter to about five millimeters, and there are two to twenty capillary tubes 10.

As shown in FIG. 17, the heat exchanger according to the sixth embodiment of the invention may comprise further a third header 5. The third header 5 is communicated with an upper portion of the inner chamber of the second header 2, and a gas-outlet pipe 51 is disposed on the third header 5 and communicated with an inner chamber of the third header 5. Alternatively, the third header 5 is communicated with the inner chamber of the second header 2 via a plurality of first connection tubes 6.

When the heat exchanger according to the sixth embodiment of the invention is used as an evaporator, as shown in FIGS. 17-18, a second refrigerator flowing out of an outlet of a condenser of a refrigeration system flows into the plurality of capillary tubes 10 from the inlet manifold 13, exchanges heat with a first refrigerant in the second header 2 when flowing in the plurality of capillary tubes 10, and then flows out of the plurality of capillary tubes 10 from the outlet manifold 14. After exchanging heat with the second refrigerant the first refrigerant is completely evaporated into a gaseous refrigerant, enters into the third header 5 through the first connection tubes 6, is discharged out of the third header 5 from the gas-outlet pipe 51, and then, for example, is sucked into a compressor.

Embodiment 7

Figure 19:
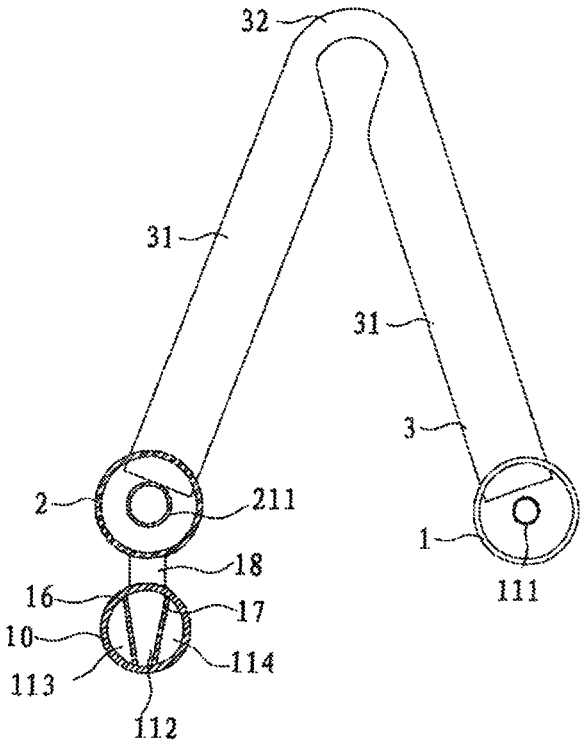
FIG. 19 is a schematic view of a heat exchanger according to a seventh embodiment of the invention.
Figure 20:
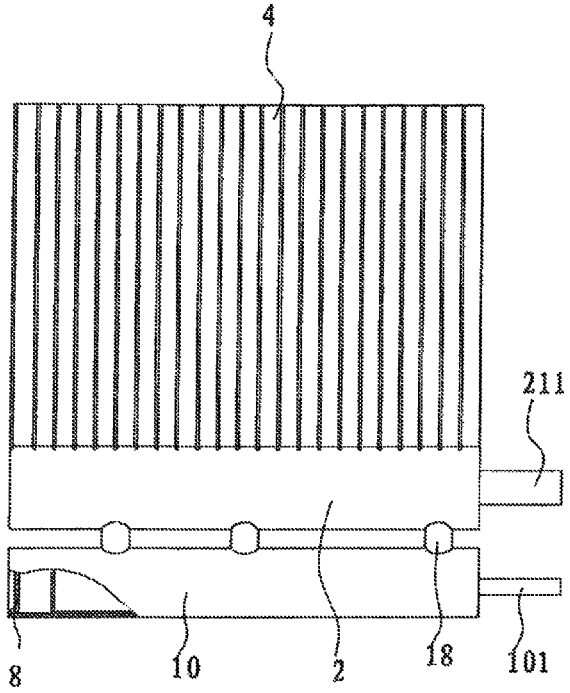
FIG. 20 is a left view of the heat exchanger shown in FIG. 19.
Figure 21:
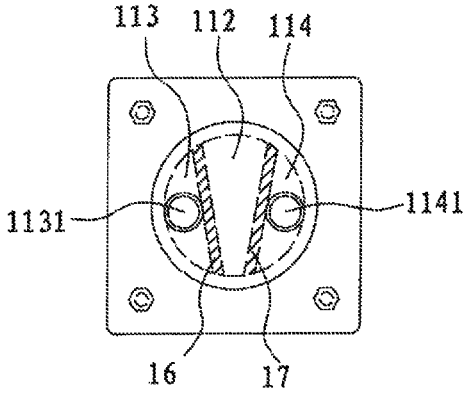
FIG. 21 is an enlarged schematic view of an end surface of a flow tube of the heat exchanger shown in FIG. 19.

As shown in FIGS. 19-21, in the heat exchanger according to a seventh embodiment of the invention, the flow member includes a flow tube 10 and third and fourth partition plates 16, 17 disposed in the flow tube 10.

As shown in FIG. 19, the third and fourth partition plates 16, 17 divide an inner chamber of the flow tube 10 into fourth, fifth, and sixth chambers 112, 113, 114, the fourth chamber 112 is communicated with an inner chamber of the second header 2, and the fifth and sixth chambers 113, 114 are communicated with each other and isolated from the fourth chamber 112. Particularly, the fifth and sixth chambers 113, 114 are communicated with each other at rear ends thereof. As shown in FIG. 21, the fifth chamber 113 is formed with an inlet 1131 in a front-end surface thereof, and the sixth chamber 114 is formed with an outlet 1141 in a front-end surface thereof. The fourth chamber 112 is communicated with the inner chamber of the second header 2 via a plurality of second connection tubes 18 connected between the flow tube 10 and the second header 2.

When the heat exchanger according to the seventh embodiment of the invention is used as an evaporator, a second refrigerator flowing out of an outlet of a condenser of a refrigeration system flows into the fifth chamber 113 from the inlet 1131 of the fifth chamber 113, flows backwardly into the sixth chamber 114, and finally flows out of the sixth chamber 114 from the outlet 1141 of the sixth chamber 114. When flowing in the fifth and sixth chambers 113, 114, the second refrigerant exchanges heat with a first refrigerant that enters into the fourth chamber 112 from the second header 2 through the second connection tubes 18. The first refrigerant, after heat exchange, may be completely evaporated into a gaseous refrigerant to flow out of the second header 2 from the outlet tube 211 of the second header 2 and then, for example, to be sucked into a compressor.

Embodiment 8

Figure 22:
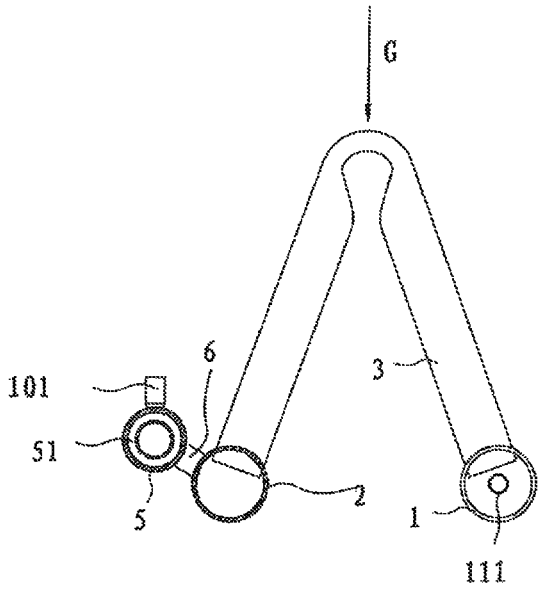
FIG. 22 is a front view of a heat exchanger according to an eighth embodiment of the invention.
Figure 23:
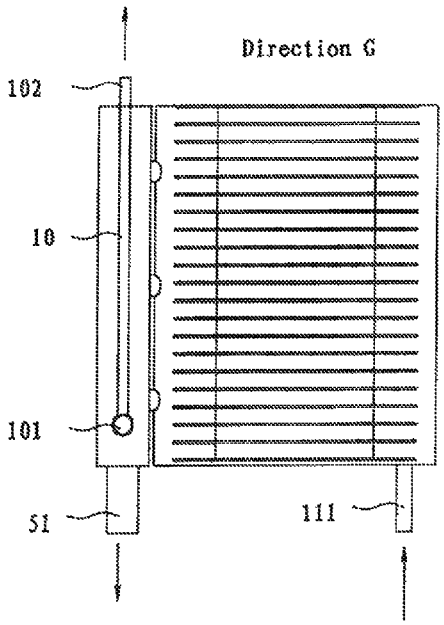
FIG. 23 is a view of the heat exchanger in a direction "G" in FIG. 22.

As shown in FIGS. 22-23, the heat exchanger according to an eighth embodiment of the invention may comprise further a third header 5. The third header 5 is communicated with an upper portion of the inner chamber of the second header 2, and a gas-outlet pipe 51 is disposed on the third header 5 and communicated with an inner chamber of the third header 5. Alternatively, the third header 5 is communicated with the inner chamber of the second header 2 via a plurality of first connection tubes 6.

The flow member includes a flow tube 10, and the flow tube 10 is disposed in the third header 5 and defines inlet and outlet ends 101, 102 that are extended out of the third header 5. As shown in FIG. 22, in one example, the inlet end 101 of the flow tube 10 is extended out from a front portion of the third header 5 along a radial direction of the third header 5, and the outlet end 102 of the flow tube 10 is extended out from a rear-end surface of the third header 5. The outlet end 102 of the flow tube 10 may be extended into the first header 1 from a rear-end surface of the first header 1 (for example, may be adjacent to an inlet of the first header 1).

As shown in FIG. 23, when the heat exchanger according to the eighth embodiment of the invention is used as an evaporator, a second refrigerator flowing out of an outlet of a condenser of a refrigeration system flows into the flow tube 10 from the inlet end 101 of the flow tube 10, exchanges heat with a first refrigerant that enters into the third header 5 from the second header 2 through the first connection tubes 6, and then flows out of the flow tube 10 from the outlet end 102 of the flow tube 10. After the first refrigerant exchanges heat with the second refrigerant, the temperature of the first refrigerant may be increased, and the first refrigerant may be completely evaporated into a gaseous refrigerant to flow out of the third header 5 from the gas-outlet pipe 51 of the third header 5 and then, for example, to be sucked into a compressor.

Embodiment 9

Figure 24:
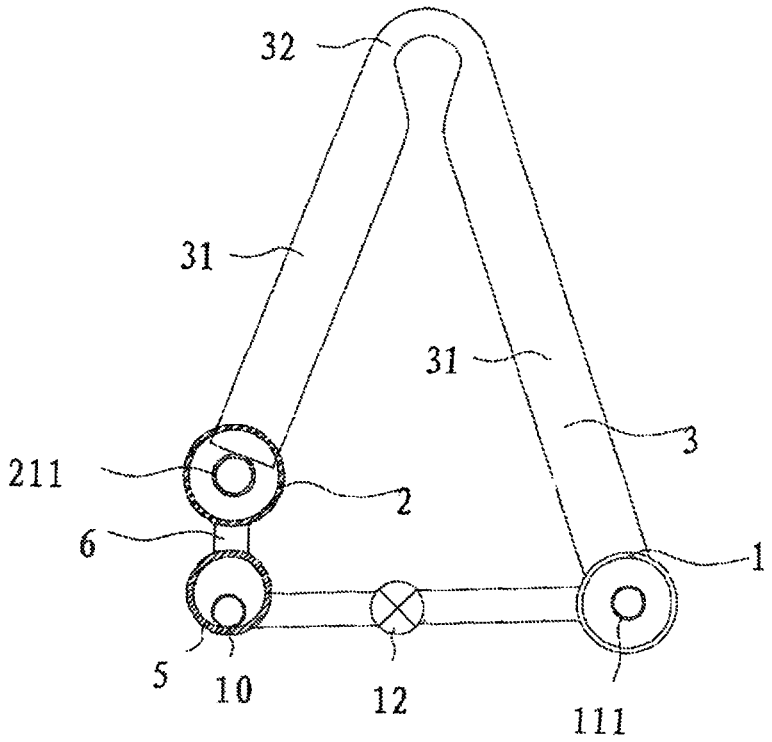
FIG. 24 is a schematic view of a heat exchanger according to a ninth embodiment of the invention.
Figure 25:
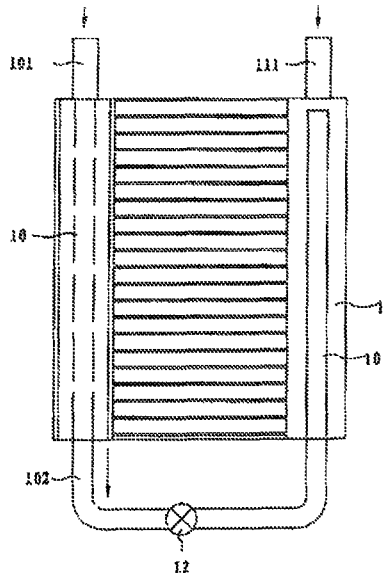
FIG. 25 is a top view of the heat exchanger shown in FIG. 24.
Figure 26:
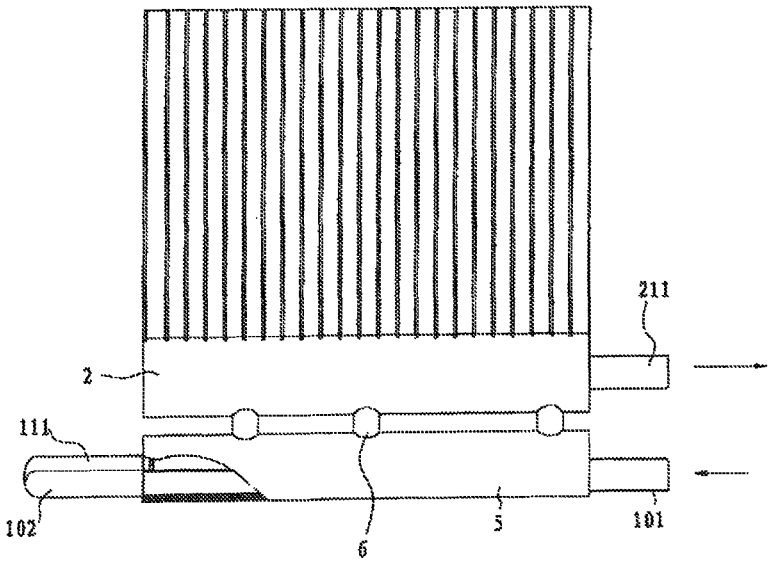
FIG. 26 is a left view of the heat exchanger shown in FIG. 24.

As shown in FIGS. 24-26, the heat exchanger according to a ninth embodiment of the invention is different from the heat exchanger according to the eighth embodiment of the invention in that no gas-outlet pipe is disposed on the third header 5 and communicated with an inner chamber of the third header 5 and the third header 5 is disposed below the second header 2. In other words, two ends of the third header 5 are closed, and the outlet of the first refrigerant is the outlet tube 211 of the second header 2.

In one example, a throttle mechanism 12, such as an expansion valve, is disposed in a portion of the flow tube 10 extended between the first header 1 and the third header 5 such that the first refrigerant may return back to the first header 1 after throttled by the expansion valve.

As shown in FIGS. 25-26, when the heat exchanger according to the ninth embodiment of the invention is used as an evaporator, a second refrigerator flowing out of an outlet of a condenser of a refrigeration system flows into the flow tube 10 from the inlet end 101 of the flow tube 10, exchanges heat with a first refrigerant that enters into the third header 5 from the second header 2, and then flows out of the flow tube 10 from the outlet end 102 of the flow tube 10. The liquid refrigerant in the first refrigerant in the third header 5 may be completely evaporated into a gaseous refrigerant and flows out of the second header 2 from the outlet tube 211 of the second header 2. In this way, the liquid refrigerant in the first refrigerant may be completely evaporated in the heat exchanger. Meanwhile, the under-cooling degree of the liquid refrigerant flowing out of the outlet end 102 of the flow tube 10 may be further increased.

The refrigeration system according to embodiments of a second aspect of the invention (for example, a refrigeration system in an air conditioner) is described below.

The refrigeration system according to embodiments of the second aspect of the invention comprises a compressor, a condenser, a throttle device, and an evaporator that are connected sequentially, wherein the evaporator is the heat exchanger according to embodiments descried above and at least part of refrigerant (i.e., the second refrigerant) flowing out of an outlet of the condenser enters info the flow member to exchange heat with the first refrigerant flowing out of an outlet of the evaporator. Because the operation and other members of the refrigeration system are known to those ordinarily skilled in the related art, a detailed description thereof is omitted here.

With the refrigeration system according to an embodiment of the invention, the first refrigerant flowing out of the outlet of the evaporator may exchange heat with the second refrigerant flowing out of the outlet of the condenser. On one hand, the under-cooling degree of the second refrigerator flowing out of the outlet of the condenser may be further increased. On the other hand, the liquid refrigerant in the first refrigerant in the evaporator may be completely evaporated in the evaporator so that no liquid refrigerant enters into the compressor and the heat-exchange capability of the heat exchanger is improved. Therefore, the entire efficiency of the refrigeration system may be enhanced.

Reference throughout this specification to "an embodiment," "some embodiments," "one embodiment," "another example, " "an example," or "some examples" means that a particular feature, structure, material, or characteristic described in connection with the embodiment or example is included in at least one embodiment or example of the invention. Thus, appearance of phrases such as "in some embodiments," "in one embodiment," "in an embodiment," "in another example," "in an example," or "in some examples" in various places herein are not necessarily referring to the same embodiment or example of the invention. Furthermore, the particular features, structures, materials, or characteristics may be combined in any suitable manner in one or more embodiments or examples.

The invention has been described above in an illustrative manner. It is to be understood that the terminology that has been used above is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A heat exchanger comprising:

a first header;

a second header spaced apart from the first header by a predetermined distance and including an inner chamber;

a plurality of flat tubes each of which defines two ends connected to the first and second headers, respectively, to communicate the first and second headers;

a plurality of fins interposed between adjacent ones of the flat tubes; and a flow member defining a fluid-flow passage and forming a partition-wall-type heat-exchanging unit with the second header, wherein at least a part of the flow member is disposed inside the second header, wherein the partition-wall-type heat-exchanging unit includes a first fluid-flow passage through which a first refrigerant flows and a second fluid-flow passage isolated from the first fluid-flow passage through which a second refrigerant flows, wherein at least a part of the inner chamber of the second header defines the first fluid-flow passage, the fluid-flow passage defined by the flow member is configured as the second fluid-flow passage, and the second refrigerant exchanges heat with the first refrigerant flowing in the first fluid-flow passage while flowing in the second fluid-flow passage.

2. The heat exchanger according to claim 1, wherein the flow member includes a first partition plate disposed in the second header along a substantially axial direction of the second header to divide an inner chamber of the second header into first, second, and third chambers, the first chamber is communicated with the flat tubes and isolated from the second and third chambers, and the second and third chambers are communicated with each other.

3. The heat exchanger according to claim 2, wherein the second and third chambers are communicated with each other at rear ends thereof, the second chamber is formed with an inlet in a front-end surface thereof, and the third chamber is formed with an outlet in a front-end surface thereof.

4. The heat exchanger according to claim 2, wherein the first partition plate is T-shaped.

5. The heat exchanger according to claim 1, wherein the flow member includes a flow tube disposed in the second header along an axial direction of the second header and defining inlet and outlet ends that are extended out of the second header.

6. The heat exchanger according to claim 5, wherein the flow tube is disposed at a lower portion of an inner chamber of the second header and the inlet and outlet ends of the flow tube are extended out from front- and rear-end surfaces, respectively, of the second header.

7. The heat exchanger according to claim 5, wherein the flow member includes further a second partition plate dividing an inner chamber of the second header into upper and lower chambers communicated with each other, the flow tube is disposed in the lower chamber, and the outlet end of the flow tube is extended into the first header.

8. The heat exchanger according to claim 7, wherein the upper and lower chambers are communicated with each other at rear ends thereof, the inlet end of the flow tube is extended out of the second header from a lower side of a front portion of the second header along a substantially radial direction of the second header, and the outlet end of the flow tube is extended out of the second header from a rear-end surface of the lower chamber.

9. The heat exchanger according to claim 7, wherein a throttle mechanism is disposed in a portion of the flow tube extended between the first and second headers.

10. The heat exchanger according to claim 5, wherein the flow tube defines a circular cross-section.

11. The heat exchanger according to claim 5, wherein the flow tube is a micro-channel tube defining a plurality of micro-channels therein.

12. The heat exchanger according to claim 11, wherein the micro-channel tube defines a substantially circular arc cross-section.

13. The heat exchanger according to claim 11, wherein the flow member includes further inlet and outlet manifolds that are connected to two ends, respectively, of the micro-channel tube and inner chambers of the inlet and outlet manifolds are communicated with the micro-channels, respectively, of the micro-channel tube.

14. The heat exchanger according to claim 11, wherein the micro-channel tube is substantially U-shaped and a plurality of corrugated sub-fins are interposed between two side walls of the micro-channel tube.

15. The heat exchanger according to claim 5, wherein the flow member includes further a plurality of capillary tubes.

16. The heat exchanger according to claim 1, wherein the heat exchanger comprises further a third header communicated with an upper portion of an inner chamber of the second header and a gas-outlet pipe is disposed and communicated with an inner chamber of the third header.

17. The heat exchanger according to claim 16, wherein the third header is communicated with the inner chamber of the second header via a plurality of first connection tubes.

18. The heat exchanger according to claim 1, wherein the flow member includes a flow tube, third and fourth partition plates are disposed in the flow tube and divide an inner chamber of the flow tube into fourth, fifth, and sixth chambers, the fourth chamber is communicated with an inner chamber of the second header, and the fifth and sixth chambers are communicated with each other and isolated from the fourth chamber.

19. The heat exchanger according to claim 18, wherein the fifth and sixth chambers are communicated with each other at rear ends thereof, the fifth chamber is formed with an inlet in a front-end surface thereof, and the sixth chamber is formed with an outlet in a front-end surface thereof.

20. The heat exchanger according to claim 18, wherein the fourth chamber is communicated with the inner chamber of the second header via a plurality of second connection tubes connected between the flow tube and second header.

21. The heat exchanger according to claim 1, wherein the heat exchanger comprises further a third header communicated with an upper portion of an inner chamber of the second header, a gas-outlet pipe is disposed and communicated with an inner chamber of the third header, and the flow member includes a flow tube disposed in the third header and defining inlet and outlet ends that are extended out of the third header.

22. The heat exchanger according to claim 21, wherein the inlet end of the flow tube is extended out from a front portion of the third header along a substantially radial direction of the third header and the outlet end of the flow tube is extended out from a rear-end surface of the third header.

23. The heat exchanger according to claim 21, wherein the outlet end of the flow tube is extended into the first header.

24. The heat exchanger according to claim 23, wherein a throttle mechanism is disposed in a portion of the flow tube extended between the first and third headers.

25. The heat exchanger according to claim 1, wherein each of the flat tubes includes a bent segment and a plurality of straight segments connected to first and second ends, respectively, of the bent segment, the bent segment is twisted relative to the straight segments by a predetermined angle, and the fins are interposed between adjacent ones of the straight segments.

26. A refrigeration system comprising:

a compressor;

a condenser;

a throttle device; and an evaporator including:

a first header;

a second header spaced apart from the first header by a predetermined distance and including an inner chamber;

a plurality of flat tubes each of which defines two ends connected to the first and second headers, respectively, to communicate the first and second headers;

a plurality of fins interposed between adjacent ones of the flat tubes; and a flow member wherein at least a part of the flow member is disposed inside the second header, said flow member defining a fluid-flow passage and forming a partition-wall-type heat-exchanging unit with the second header, wherein the partition-wall-type heat-exchanging unit includes a first fluid-flow passage through which a first refrigerant flows and a second fluid-flow passage isolated from the first fluid-flow passage through which a second refrigerant flows, wherein at least a part of the inner chamber of the second header defines the first fluid-flow passage, the fluid-flow passage defined by the flow member is configured as the second fluid-flow passage, and the second refrigerant exchanges heat with the first refrigerant flowing in the first fluid-flow passage while flowing in the second fluid-flow passage, wherein the compressor, condenser, throttle device, and evaporator are connected sequentially, at least part of refrigerant flowing out of an outlet of the condenser enters into the flow member to exchange heat with a refrigerant flowing out of an outlet of the evaporator.

* * * * *